US007726986B2

(12) United States Patent
Wang

(10) Patent No.: US 7,726,986 B2
(45) Date of Patent: Jun. 1, 2010

(54) ELECTRICAL CONNECTOR HAVING METAL SHELL EQUIPPED WITH A PAIR OF OUTWARDLY PROTRUDING RESILENT ARMS OFFSET FROM EACH OTHER

(75) Inventor: Ji-Cheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,406

(22) Filed: Dec. 22, 2008

(65) Prior Publication Data

US 2009/0163070 A1 Jun. 25, 2009

(30) Foreign Application Priority Data

Dec. 21, 2007 (CN) ..... 2007 2 0131651 U

(51) Int. Cl.
*H01R 4/66* (2006.01)

(52) U.S. Cl. ..... 439/108

(58) Field of Classification Search ..... 439/188, 439/101, 108, 607, 608, 358, 352, 378
See application file for complete search history.

(56) References Cited

U.S. PATENT DOCUMENTS 4,512,623 A * 4/1985 Tomsa ..... 439/607.17
5,685,739 A * 11/1997 Davis et al. ..... 439/607.38
6,722,924 B1 * 4/2004 Zhou et al. ..... 439/607.23
6,902,432 B2 * 6/2005 Morikawa et al. ..... 439/607.41
6,923,689 B2 * 8/2005 Xue et al. ..... 439/676
D518,789 S * 4/2006 Sakamaki et al. ..... D13/147
7,578,705 B2 * 8/2009 He et al. ..... 439/660
2006/0148300 A1 * 7/2006 Huang et al. ..... 439/353

FOREIGN PATENT DOCUMENTS

TW M277149 10/2005
TW M289243 4/2006

* cited by examiner

*Primary Examiner*—Chandrika Prasad
(74) *Attorney, Agent, or Firm*—Andrew C. Cheng; Wei Te Chung; Ming Chieh Chang

(57) ABSTRACT

An electrical connector includes an insulating housing (1) having four side walls interconnecting with each other and defining a receiving space (10) therein. Only one of the side walls defines a plurality of terminal grooves therein and a plurality of terminals (22) are mounted in said terminal grooves. A metallic shell (4) covers on the insulating housing and said shell (4) has a first resilient arm (431) extending in a first direction with a first contacting portion (4311) bending outwardly, and a second resilient arm (432) extending in a reverse direction toward the first resilient arm with a second contacting portion (4321) bending outwardly. The first and second resilient arms (431, 432) space away from each other in a transverse direction perpendicular to said first direction, and said first and second contacting portions (4311, 4321) offset with each other in said first direction.

1 Claim, 5 Drawing Sheets

ELECTRICAL CONNECTOR HAVING METAL SHELL EQUIPPED WITH A PAIR OF OUTWARDLY PROTRUDING RESILENT ARMS OFFSET FROM EACH OTHER

BACKGROUND OF THE INVENTION

1. Field of the Invention

The present invention relates to an electrical connector, and particularly to an electrical connector with a metallic shell therearound.

2. Description of the Related Art

For an electrical connector, especially the electrical connector in the field of high frequency communication, a metallic shell is usually provided to reduce the influence of the electromagnetic interference (EMI) by mechanically and electrically contacting with a casing, which is used for accommodating the electrical connector. TW patents No. M289243 and M277149 respectively disclose such an electrical connector with a metallic shell forming with a pair of resilient arms thereon. The pair of resilient arms respectively extend from a front portion of a side wall along a front-to-rear direction for contacting with the casing so as to release the current centralized thereon. Because the pair of resilient arms are formed at the same side of the side wall, the electrical connector may incline toward the other side of the side wall when the electrical connector is received in the casing with the metallic shell contacting with the casing. Therefore, a steadily electrical contact can not be provided between the metallic shell of the electrical connector and the casing. Hence, an electrical connector is needed to solve the problem.

SUMMARY OF THE INVENTION

Accordingly, an object of the present invention is to provide an electrical connector having a metallic shell therearound, and the metallic shell keeps a steadily electrical and mechanical contact with an outer device such as a casing.

In order to achieve the object set forth, an electrical connector comprises an insulating housing having four side walls interconnecting with each other and defining a receiving space therein. Only one of the side walls defines a plurality of terminal grooves therein and a plurality of terminals are mounted in said terminal grooves. A metallic shell covers on the insulating housing, and said shell has a first resilient arm extending in a first direction with a first contacting portion bending outwardly, and a second resilient arm extending in a reverse direction toward the first resilient arm with a second contacting portion bending outwardly. The first and second resilient arms space away from each other in a transverse direction perpendicular to said first direction, and said first and second contacting portions offset with each other in said first direction.

Other objects, advantages and novel features of the invention will become more apparent from the following detailed description of the present embodiment when taken in conjunction with the accompanying drawings.

DETAILED DESCRIPTION OF THE INVENTION

Figure 1:
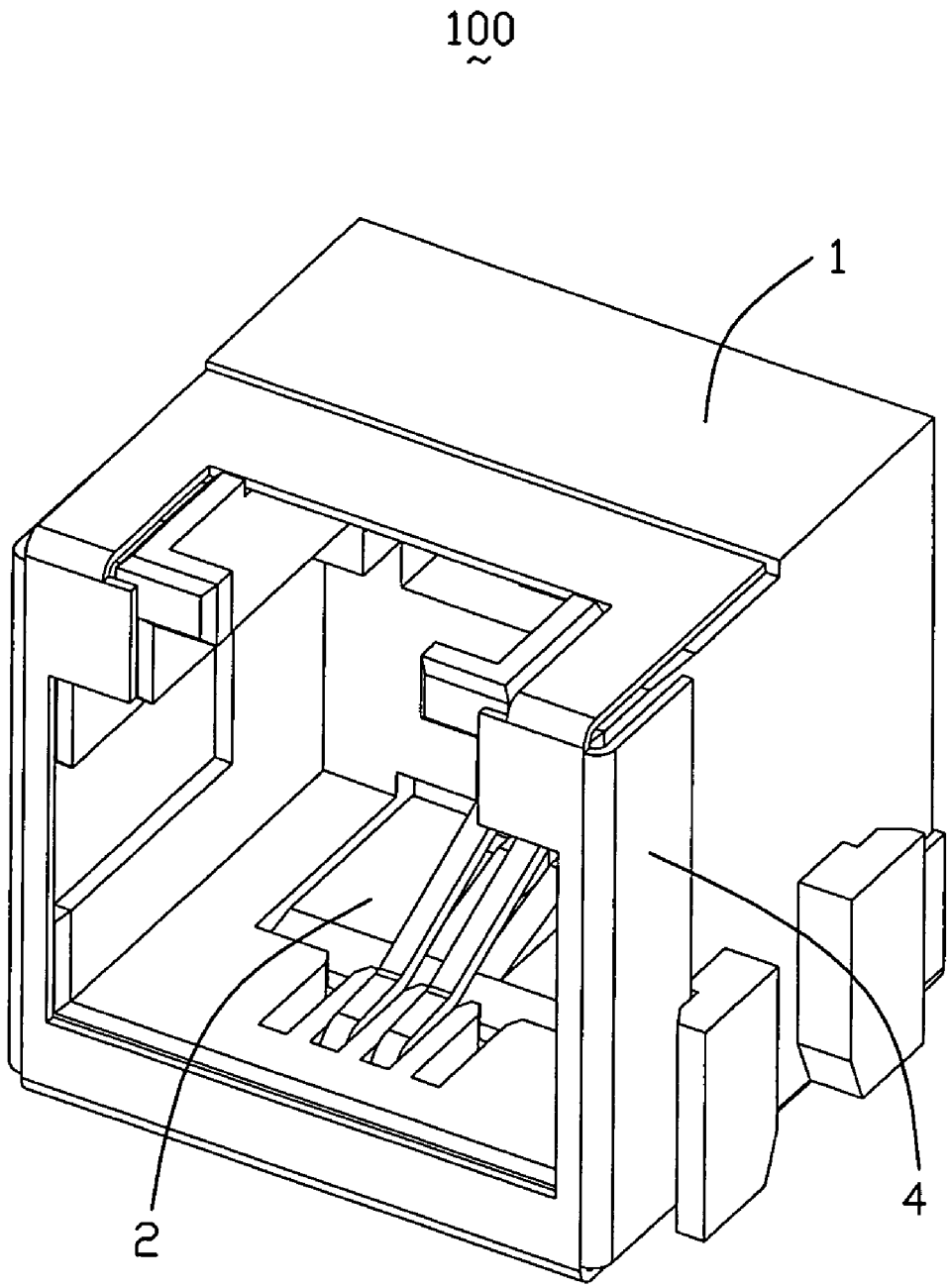
FIG. 1 is a perspective view of an electrical connector in accordance with the present invention.
Figure 2:
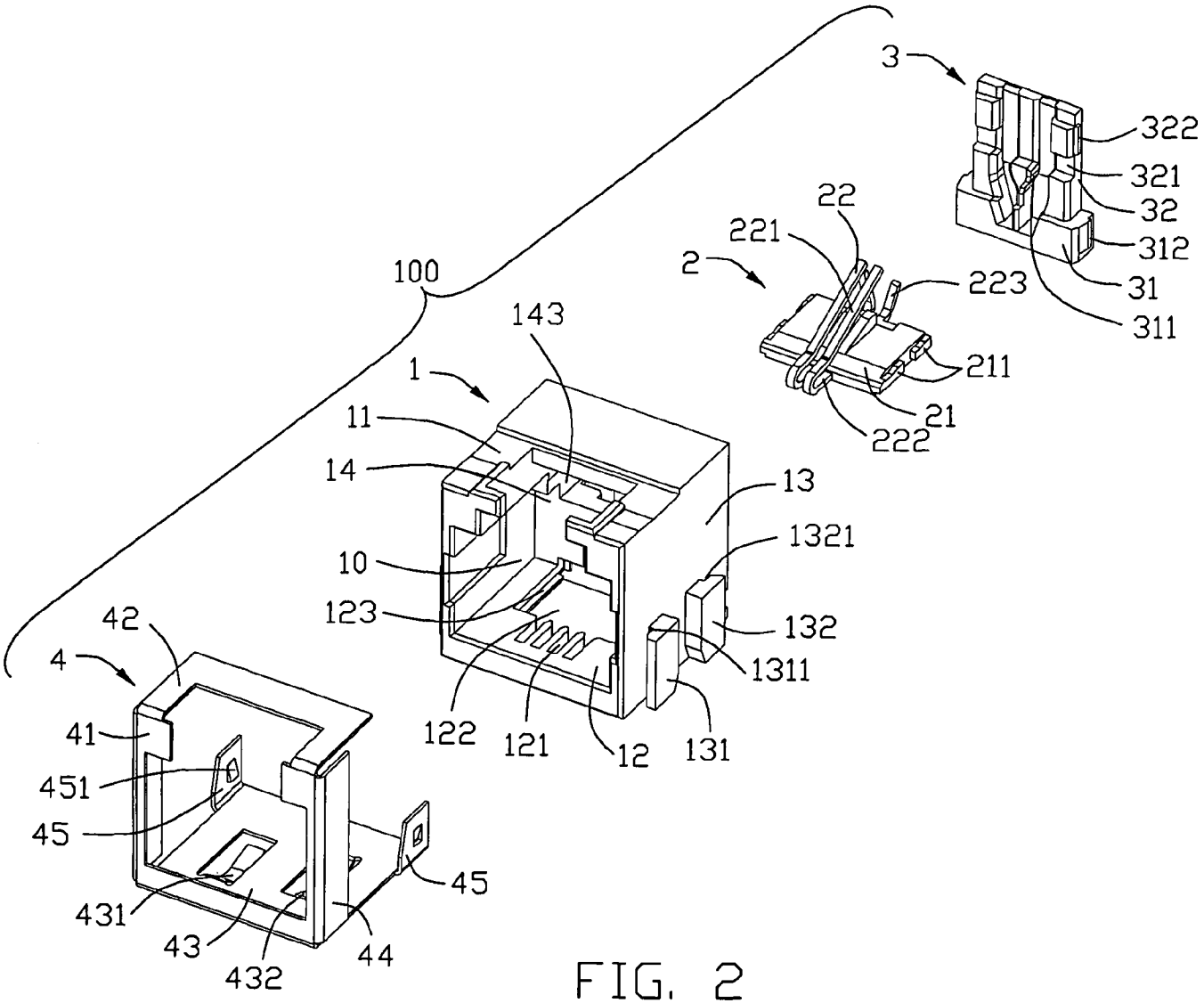
FIG. 2 is an exploded view of the electrical connector shown in FIG. 1.

Reference will now be made to the drawing figures to describe a preferred embodiment of the present invention in detail. Referring to FIGS. 1 and 2, an electrical connector 100 according to the preferred embodiment of the present invention is provided and comprises an insulating housing 1, a terminal module 2 received in the insulating housing, a retaining device 3 and a metallic shell 4 covering on the insulating housing.

Figure 3:
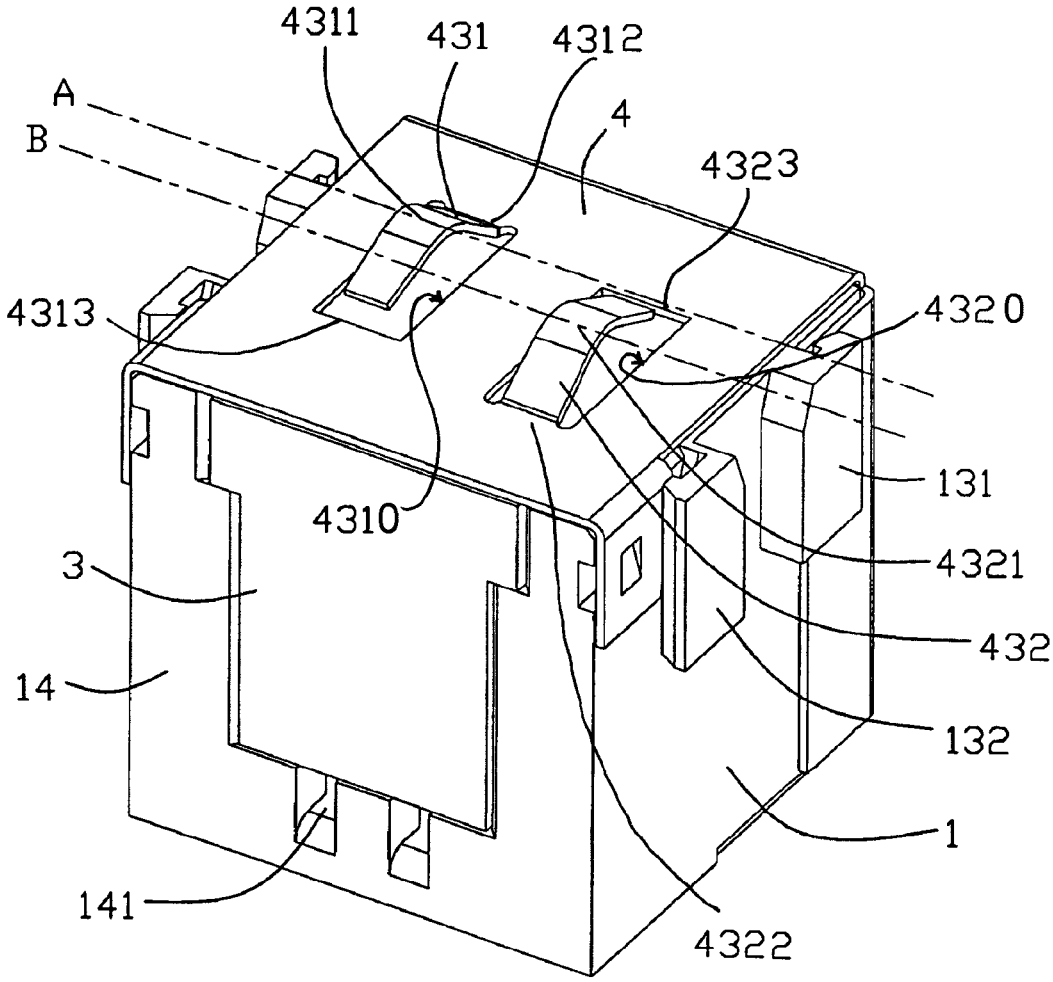
FIG. 3 is another perspective view of the electrical connector shown in FIG. 1.
Figure 4:
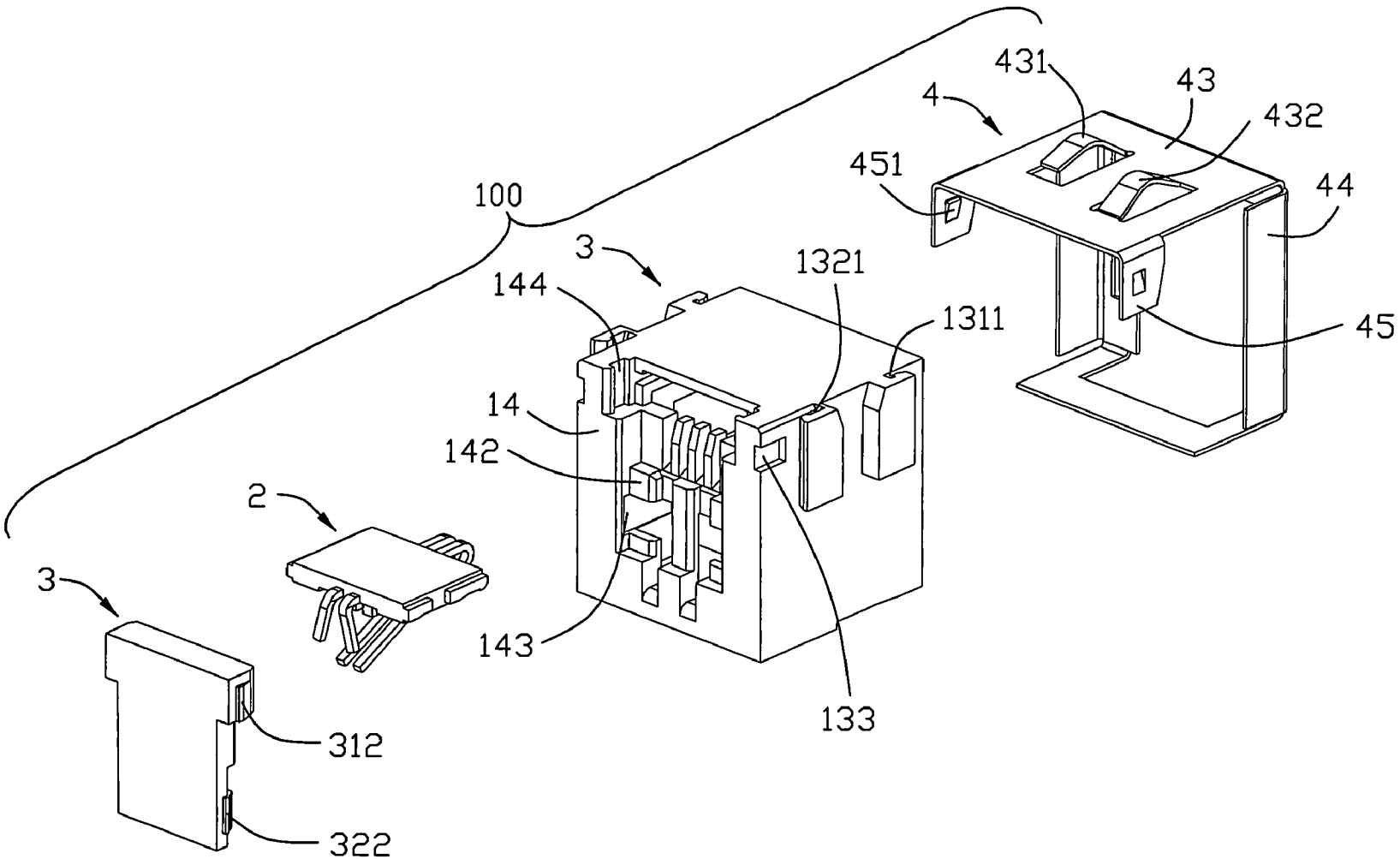
FIG. 4 is an exploded view of the electrical connector shown in FIG. 3.
Figure 5:
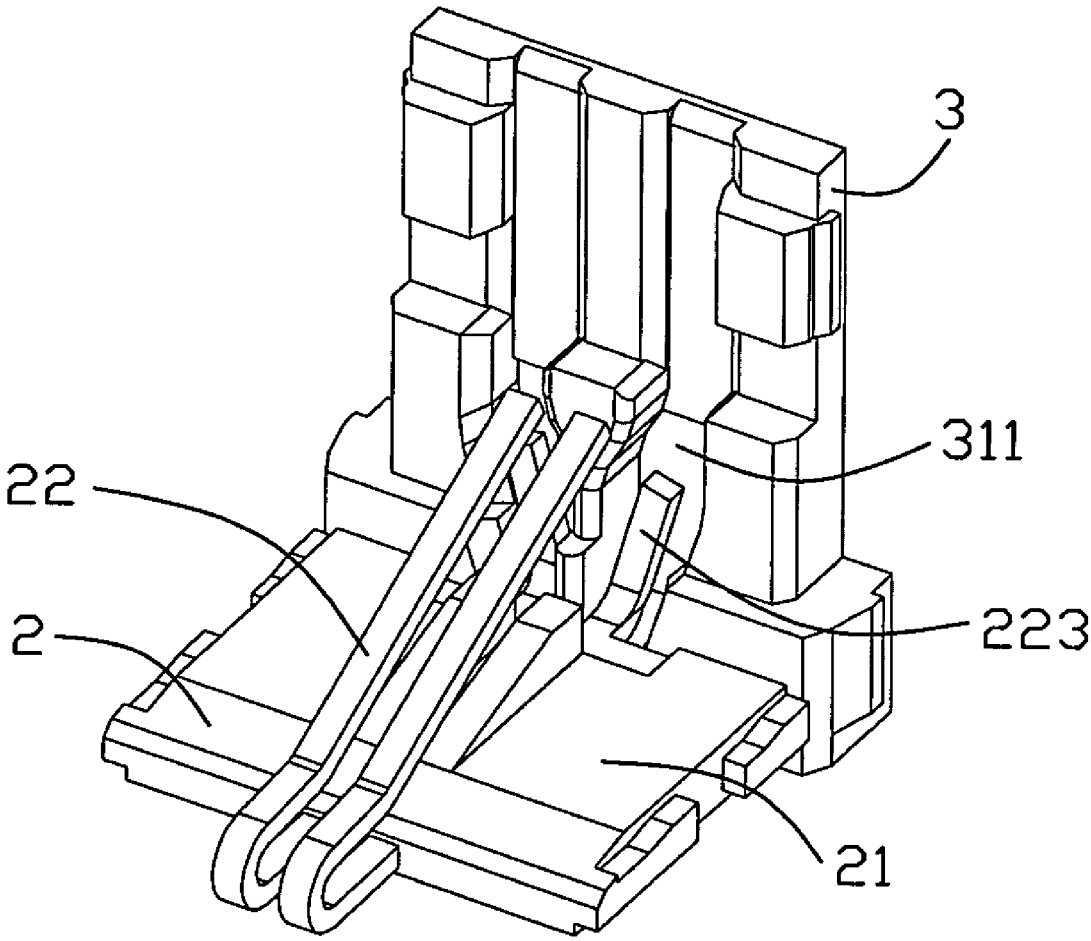
FIG. 5 is a perspective view of a terminal module mounted on a retaining device.

Referring to FIGS. 2 and 4, the insulating housing comprises an upper wall 11, a lower wall 12 opposite the upper wall 11, a pair of side walls 13 and a rear wall 14 interconnecting said upper wall, lower wall and side walls. A plurality of terminal receiving grooves 121 are arranged at intervals and extend rearward from a front portion of an inner side of the lower wall 12. A receiving cavity 122 is defined at a rear portion of the receiving grooves 121 and excavated downwardly in the lower wall 12, and a pair of locking passageways 123 are respectively defined at opposite sides of the receiving cavity in the same extending direction of the receiving grooves. A pair of protrusions 131,132 are respectively formed on each side wall 13 and each protrusion defines a channel 1311, 1321 therein. An aperture 133 is respectively formed at a rear portion of each side wall adjacent the protrusions 131, 132. Referring to FIG. 3, an opening 141 is defined in the rear wall 14 for allowing the cables to be inserted therein.

The terminal module 2 comprises a holding portion 21 and a plurality of conductive terminals 22 mounted therein. Each terminal 22 comprises a contacting portion 221 for electrically contacting with a mating connector (not shown), a connecting portion 222 extending from one end of the contacting portion 221 and secured in the holding portion 21, and a soldering portion 223 extending from one end of connecting portion 222 upwardly and outwardly. Moreover, the contacting portion 221 extends upwardly and slantwise from one end of the connecting portion 222, while the soldering portion 223 extends from the other end of connecting portion 222 slantwise and outwardly, therefore the distance between the adjacent soldering portions 223 are larger than that of the connecting portion 222. A pair of ribs 211 are respectively formed on each side of the holding portion 21.

The retaining device 3 comprises a base portion 31 and a body portion 32 extending upwardly from the base portion 31. A pair of slots 311 extend from a middle portion of the base portion 31 till the end of the body portion 32 for receiving a cable (not shown). A pair of apertures 321 are respectively formed at opposite sides of the body portion 32 to accommodate corresponding blocks 142 formed on the rear wall 14. Two pairs of blocks 312, 322 are respectively formed on sides of the base portion 31 and body portion 32 to cooperate with the grooves 143, 144 defined in the rear wall 14.

Referring to FIGS. 2 and 3, the metallic shell 4 comprises a front wall 41, an upper wall 42 and a bottom wall 43 extending rearward from opposite sides of the front wall 41, a pair of first pieces 44 extending rearward from right and left sides of the front wall 41, and a pair of second pieces 45 extending upward from opposite sides of the rear portion of the bottom wall 43. Each second piece 45 comprises a locking portion 451 therein. A first resilient arm 431 extends from a front portion of the bottom wall 43 along a front-to-rear direction and bends outwardly to form a first curved contacting portion 4311 below the bottom wall 43 thereof. A second resilient arm 432 extends from a rear portion of the bottom wall 43 along a rear-to-front direction and bends outwardly to form a second curved contacting portion 4321 below the bottom wall 43 thereof. The first and second resilient arms 431, 432 extend in opposite direction and space away from each other in a transverse direction perpendicular to the front-to-rear direction. The first and second curved contacting portions 4311, 4321 offset to each other in the front-to-rear direction (as shown in FIG. 3, the first and second curved contacting portion 4311, 4321 are respectively defined on the lines A and B).

When the electrical connector is assembled, the terminal module 2 is inserted into the receiving cavity 122 with ribs 211 fixed in the locking passageways 123 and connecting portion 222 received in the terminal groove 121. The retaining device 3 is received in the opening 141 on the rear wall 14 and abuts against the terminal module 2, meanwhile the blocks 312,322 are respectively received in the grooves 143, 144, the blocks 142 are secured in the apertures 321, and the soldering portions 223 are retained in the slots 311. The metallic shell 4 covers on the insulating housing 1 with the first pieces 44 and second pieces 45 respectively received in the channels 1311, 1321, and locking portions 451 locked with apertures 133.

As the first and second resilient arms or tangs 431, 432 extend from opposite sides of the bottom wall 43 and dispose offset with each other in the front-to-rear direction, when the electrical connector is assembled in an outer device such as a casing, the first and second resilient arms 431, 432 can mechanically and electrically contact with the casing in a good balance state so as to release the current centralized thereon. Referring to FIG. 3, the bottom wall 43 defines two openings 4310, 4320 dimensioned similar to each other and corresponding to the pair of tangs 431, 432 in an offset manner. Each arm 431/432 unitarily extends from a starting edge 4312/4322 of the corresponding opening 4310/4320 to an opposite ending edge 4313/4323 of the same opening 4310/4320, and the ending edge 4313/4323 of one opening 4310/4320 is essentially located between the starting edge 4322/4312 and the ending edge 4323/4313 of the other opening 4320/4310 in the front-to-back direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining at least one plate covering said exterior surface; wherein a pair of tangs having essentially a same dimension and unitarily stamped from said plate in a side by side relation while in opposite directions along a front-to-back direction;

wherein the pair of tangs protrude outwardly away from the housing; wherein said plate defines two openings dimensioned similar to each other and corresponding to said pair of tangs in an offset manner, each of said tangs unitarily extends from a starting edge of the opening to an opposite ending edge of the same opening, and the ending edge of one opening is essentially located between the starting edge and the ending edge of the other opening in said front-to-back direction.

* * * * *